US008756827B1

(12) United States Patent
Calabro et al.

(10) Patent No.: US 8,756,827 B1
(45) Date of Patent: Jun. 24, 2014

(54) SPRAY BOOTH SYSTEM AND METHODS

(75) Inventors: Matthew A. Calabro, Auburndale, FL (US); James P. Calabro, Winter Haven, FL (US)

(73) Assignee: The Paint Booth Guys, Inc., Auburndale, FL (US)

( * ) Notice: Subject to any disclaimer, the term of this patent is extended or adjusted under 35 U.S.C. 154(b) by 264 days.

(21) Appl. No.: 13/441,445

(22) Filed: Apr. 6, 2012

Related U.S. Application Data

(60) Provisional application No. 61/485,389, filed on May 12, 2011.

(51) Int. Cl.
*F26B 3/00* (2006.01)

(52) U.S. Cl.
USPC ..... 34/487; 34/218; 34/666; 118/64; 118/312; 454/54; 454/238; 432/64; 432/145; 15/316.1; 219/411

(58) Field of Classification Search
USPC ..... 34/270, 380, 381, 413, 497, 90, 105, 34/201, 210, 218, 666; 118/64, 300, 312; 454/52, 54, 312; 432/64, 114, 145; 15/312.1, 316.1; 219/400, 405, 411
See application file for complete search history.

(56) References Cited

U.S. PATENT DOCUMENTS

| | | | | | |
|---|---|---|---|---|---|
| 2,132,826 | A | * | 10/1938 | Ludwig | 454/52 |
| 3,391,630 | A | * | 7/1968 | Wilhelmsson | 454/52 |
| 4,335,526 | A | * | 6/1982 | Smith | 34/229 |
| 4,378,728 | A | * | 4/1983 | Berkmann | 454/53 |
| 4,608,064 | A | * | 8/1986 | Napadow | 96/307 |
| 4,700,615 | A | * | 10/1987 | Napadow | 454/54 |
| 4,771,552 | A | * | 9/1988 | Morioka | 34/222 |
| 4,923,489 | A | * | 5/1990 | Hanson | 96/246 |
| 5,034,042 | A | * | 7/1991 | Allen, Jr. | 55/385.2 |
| 5,042,420 | A | * | 8/1991 | Gerdes | 118/50.1 |
| 5,153,034 | A | * | 10/1992 | Telchuk et al. | 427/424 |
| 5,397,394 | A | * | 3/1995 | Orr | 118/634 |
| 5,456,023 | A | * | 10/1995 | Farnan | 34/270 |
| 5,480,349 | A | * | 1/1996 | Kolta | 454/52 |
| 5,505,763 | A | * | 4/1996 | Reighard et al. | 95/19 |
| 5,555,649 | A | * | 9/1996 | Phillipson | 34/666 |
| 5,596,818 | A | * | 1/1997 | Jones | 34/666 |
| 5,607,498 | A | * | 3/1997 | Reighard et al. | 95/19 |
| 5,661,912 | A | * | 9/1997 | Bhatnagar et al. | 34/270 |

(Continued)

FOREIGN PATENT DOCUMENTS

| | | | | | |
|---|---|---|---|---|---|
| DE | 19937193 | A1 | * | 2/2001 | B05D 3/00 |
| GB | 1042215 | | * | 9/1966 | B05C 15/00 |
| JP | 57099363 | A | * | 6/1982 | B05C 15/00 |
| WO | WO 9817402 | A1 | * | 4/1998 | B05B 15/12 |

*Primary Examiner* — Steve M Gravini
(74) *Attorney, Agent, or Firm* — Nilay J. Choksi; Jeremy Spier; Smith & Hopen, P.A.

(57) ABSTRACT

The current invention discloses a novel spray booth containing a plurality of spacers disposed on the walls or ceiling, and a plurality of fans attached to the spacers. A spacer allows a fan to be disposed at an angle and at a certain distance away from the wall or ceiling, allowing sufficient airflow for spraying or curing an object within the housing. Having fans emit airflow toward both the top and the sides of an object allows optimal coating and heating of the object. A ceiling fan may also be disposed within a plenum in the ceiling of the spray booth.

15 Claims, 6 Drawing Sheets

(56) References Cited

U.S. PATENT DOCUMENTS

| | | | | |
|---|---|---|---|---|
| 5,793,019 | A * | 8/1998 | Boyle et al. | 219/400 |
| 5,820,456 | A * | 10/1998 | Nelson | 454/52 |
| 5,875,565 | A * | 3/1999 | Bowman | 34/666 |
| 6,093,250 | A * | 7/2000 | Salazar et al. | 118/668 |
| 6,226,568 | B1 * | 5/2001 | Tong et al. | 700/277 |
| 6,533,654 | B2 | 3/2003 | DeRegge | |
| 6,895,689 | B2 * | 5/2005 | Ueno | 34/270 |
| 7,045,013 | B2 * | 5/2006 | DeRegge | 118/326 |
| 7,150,112 | B2 * | 12/2006 | Faytlin | 34/666 |
| 7,200,953 | B2 * | 4/2007 | Sonner et al. | 34/225 |
| 7,484,316 | B2 * | 2/2009 | Wimmer et al. | 34/666 |
| 8,156,689 | B2 * | 4/2012 | Benzinger | 52/36.2 |
| 8,510,968 | B2 * | 8/2013 | Bunnell | 34/666 |
| 8,528,232 | B1 * | 9/2013 | Ennis | 34/666 |
| 8,545,461 | B2 * | 10/2013 | Thomason et al. | 604/289 |
| 8,613,147 | B2 * | 12/2013 | McElroy et al. | 34/666 |
| 2002/0050770 | A1 * | 5/2002 | Cocker | 312/107 |

* cited by examiner

SPRAY BOOTH SYSTEM AND METHODS

CROSS-REFERENCE TO RELATED APPLICATIONS

This application claims priority to U.S. Provisional Application No. 61/485,389, entitled "Spray Booth System and Methods," filed on May 12, 2011, the contents of which are hereby incorporated by reference into this disclosure.

BACKGROUND OF THE INVENTION

1. Field of the Invention

This invention relates generally to spray booths. More specifically, it relates to the creation of airflow onto the surface of an object without the addition of external air into the spray booth.

2. Description of the Related Art

When painting a vehicle or other object, drying or curing times can limit the amount of throughput. One common way to spray a vehicle is by using a spray booth. These booths provide advantages such as reducing particulate, confining paint overspray and evaporated solvents, and reducing drying times. To accelerate drying, air is flowed through the booth and over the vehicle. For waterborne paints, water in the paint travels to the surface to evaporate. As the air flows over the surface of the paint, it tends to enhance evaporation of the water, thereby reducing drying times.

A wide variety of spray booths are in existence. Perhaps the most common types are downdraft and semi-vertical spray booths that use a housing positioned over an open floor grate or an exhaust outlet near the bottom of the walls. Air from the ceiling and any entrained paint overspray and solvents are drawn downward over the vehicle during spraying and drying and are then exhausted through the floor grate or exhaust opening.

An example of such spray booths are described in U.S. Pat. Nos. 6,533,654 and 7,045,013, incorporated herein by reference. Typical flow rates may be about 80 to 100 feet per minute over horizontal surfaces. Even at elevated temperatures and a down draft of semi-vertical draft, it can take up to 40 minutes for the entire vehicle to dry sufficiently to permit removal from the spray booth. Until the automobile is dry, it is usually maintained in the spray booth to prevent damage to the soft paint.

To reduce drying times, some have used heaters to increase the temperature within the booth. Others have tried to increase flow rates using nozzles. See, for example, U.S. Pat. No. 5,456,023, the complete disclosure of which is herein incorporated by reference. This invention is related to other techniques for reducing drying and curing times.

The prior art has also contemplated a plenum within the ceiling of the spray booth with filter media directly above a fan that blows air onto the top of the object in the spray booth. However, having filter media on the top side plenum directly above the fan hinders the maximum amount of air being filtered through the plenum, particularly if air is not directly added into the filter.

Accordingly, what is needed is an improved, more efficient spray booth that will reduce drying and curing times while drying more evenly over the entirety of the vehicle or other object. However, in view of the art considered as a whole at the time the present invention was made, it was not obvious to those of ordinary skill how the art could be advanced.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The long-standing but heretofore unfulfilled need for an improved, more efficient and more evenly dispersing spray booth system is now met by a new, useful and nonobvious invention.

In an embodiment, a novel spray booth comprises a housing with walls and a ceiling, a plurality of spacers disposed on the walls or ceiling, and a plurality of fans attached to the spacers. A spacer allows a fan to be disposed at an angle between about 20 degrees and about 70 degrees at a certain distance away from the wall or ceiling. This allows sufficient air to enter the fan and be emitted as airflow to spray or cure an object within the housing.

Each spacer may further contain a mounting frame, which is a sturdier support structure disposed on the walls.

The spacers may have a length from about two inches to about eight inches.

Each spacer and fan combination can be attached to the wall or ceiling near the intersection of the wall and ceiling. Thus, the fans can be pointed down at an angle at the object being sprayed.

The spray booth may further contain a plenum with recess, filter media on the sides of the plenum for purifying air or gas flowing through the filter media, and a ceiling fan disposed within the recess of the plenum.

The spray booth may further include a selectable fan zone control for controlling which fans are engaged at a particular time.

A user may control each fan to gradually increase airflow onto the object, for example by gradually increasing speed of the fan.

A user may control each fan to pulse, so airflow can be repeatedly increased and decreased over the object to allow for even heating over the surface of the object.

The spray booth may further include a control panel connected mechanically or wirelessly to each fan. The control panel can control any aspect of the fan's operation, including timing of operation, speed, pulsating frequency, etc.

In a separate embodiment, the current invention discloses a method of spray drying a vehicle. A spray booth as disclosed is provided, along with a plurality of fans disposed therein on the walls of the spray booth. A ceiling fan is also disposed within the recess of a plenum within the ceiling of the spray booth. A user can determine which fans need to be operated, and engage those fans at a predetermined speed. A user may also determine whether fans should be pulsed, and if so, the user may engage the fans at a pulsating frequency. The vehicle is then allowed to receive the airflows created by the fans and ceiling fan, so the vehicle can be dried.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

Figure 1:
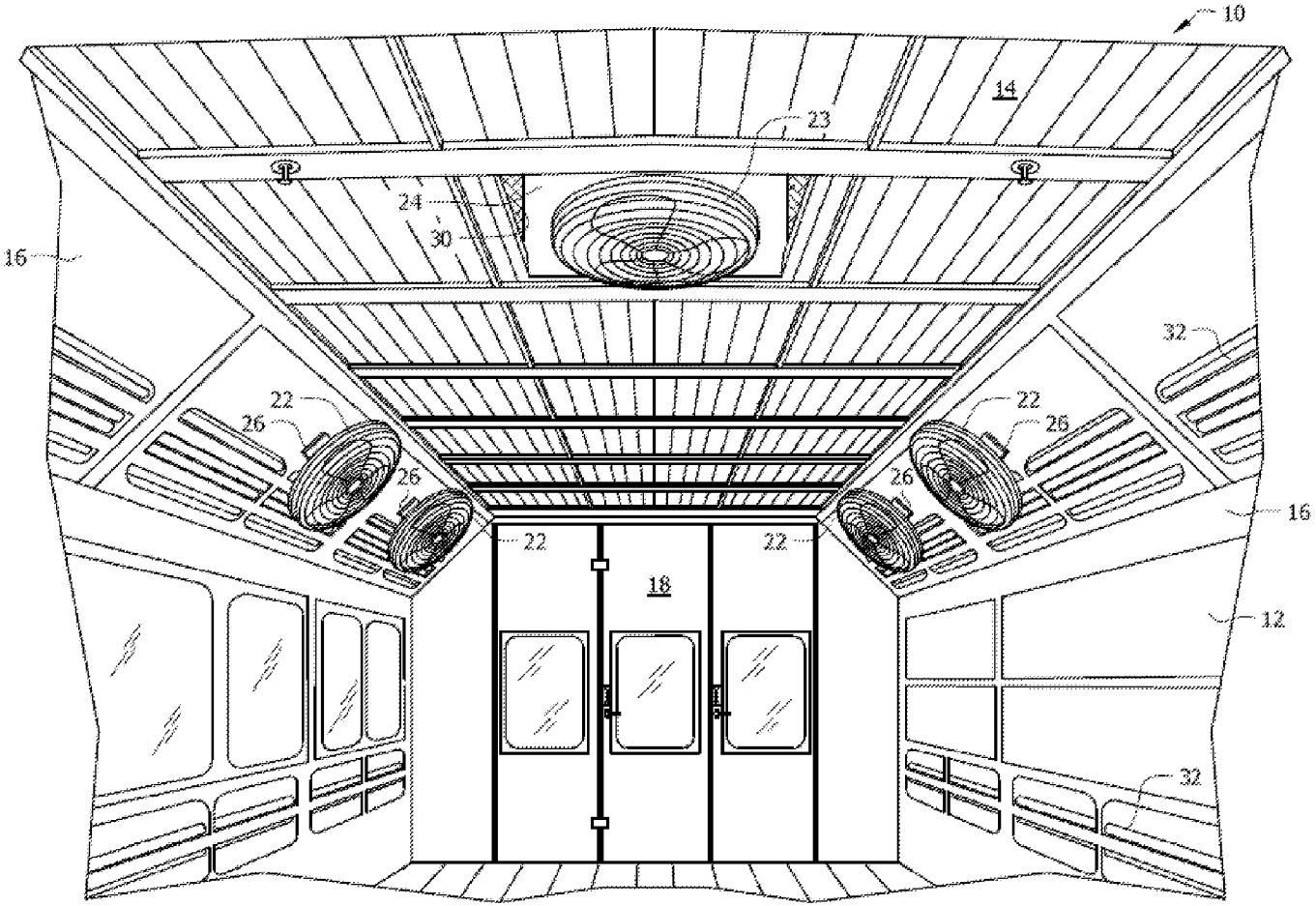
FIG. 1 is a schematic of a spray booth.

As depicted in FIG. 1, the claimed invention includes a spray booth generally denoted as reference 10. Spray booth 10 includes spray booth housing 12 having ceiling 14 and side walls 16 that define interior 18 for holding object 34 to be sprayed, such as a vehicle. Pressurized air plenum 20 is disposed above ceiling 14 and is adapted to supply air into interior 18 similar to U.S. Pat. No. 7,045,013, which is hereby incorporated by reference. Filter media 30 is used to filter air from plenum 20 before entering into interior 18. At least one fan 22 is disposed within spray booth 10.

Figure 2:
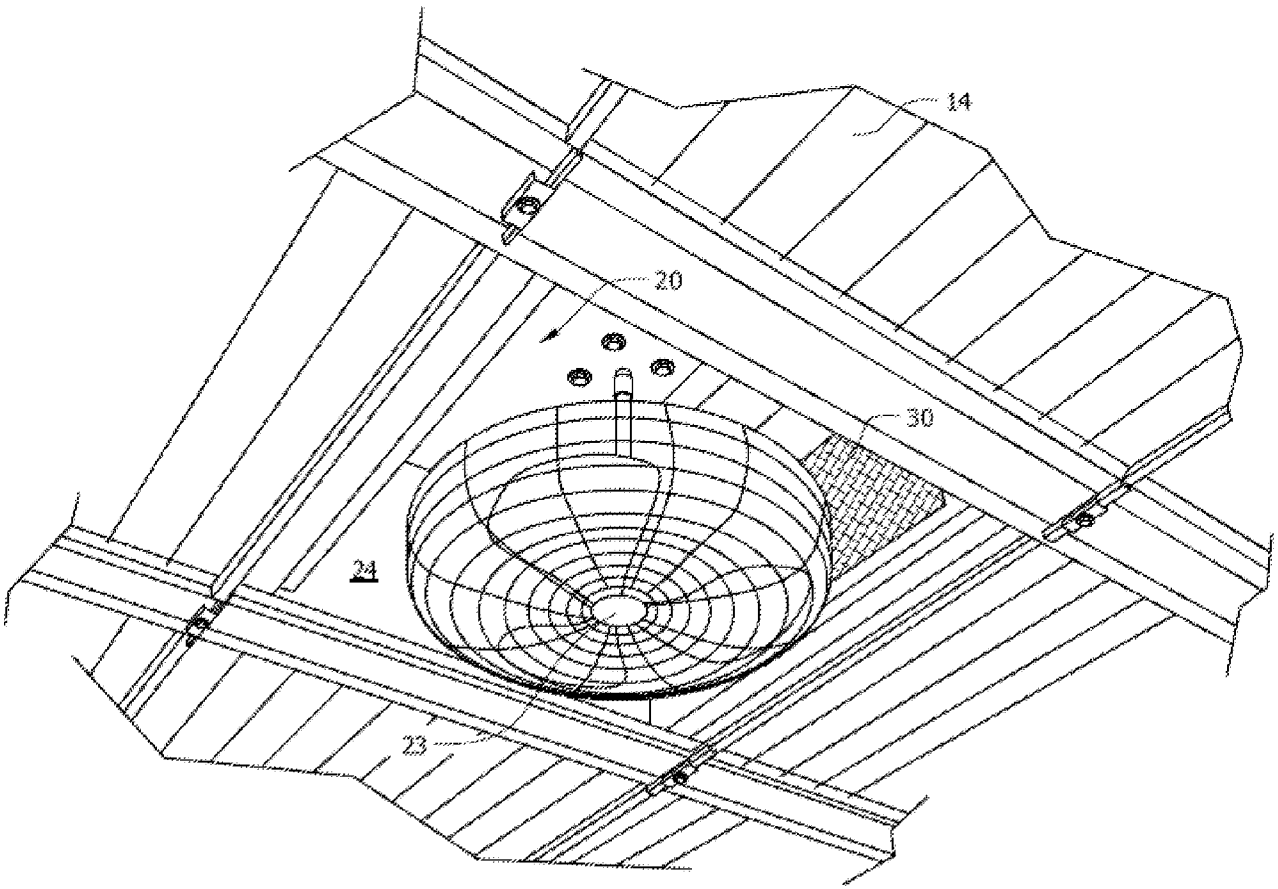
FIG. 2 is a schematic of a plenum within a spray booth.

Referring to FIGS. 1-2, an embodiment includes overhead fan 23 disposed in recess 24 in ceiling 14 of spray booth housing 10 below filter media 30 and plenum 20. Recess 24 raises overhead fan 23 outside of interior 18 of spray booth 10 allowing greater height clearances for larger objects. Overhead fan 23 increases the air suction over filter media 30 within plenum 20 and increases airflows in the vicinity of object 34 to increase evaporation rates associated with a spray application on object 34 during a spray, dry, and/or cure cycle. In this way, enhanced airflows over object 34 may be achieved without increasing air flows through plenum 20. As such, drying times may be significantly reduced.

Figure 4:
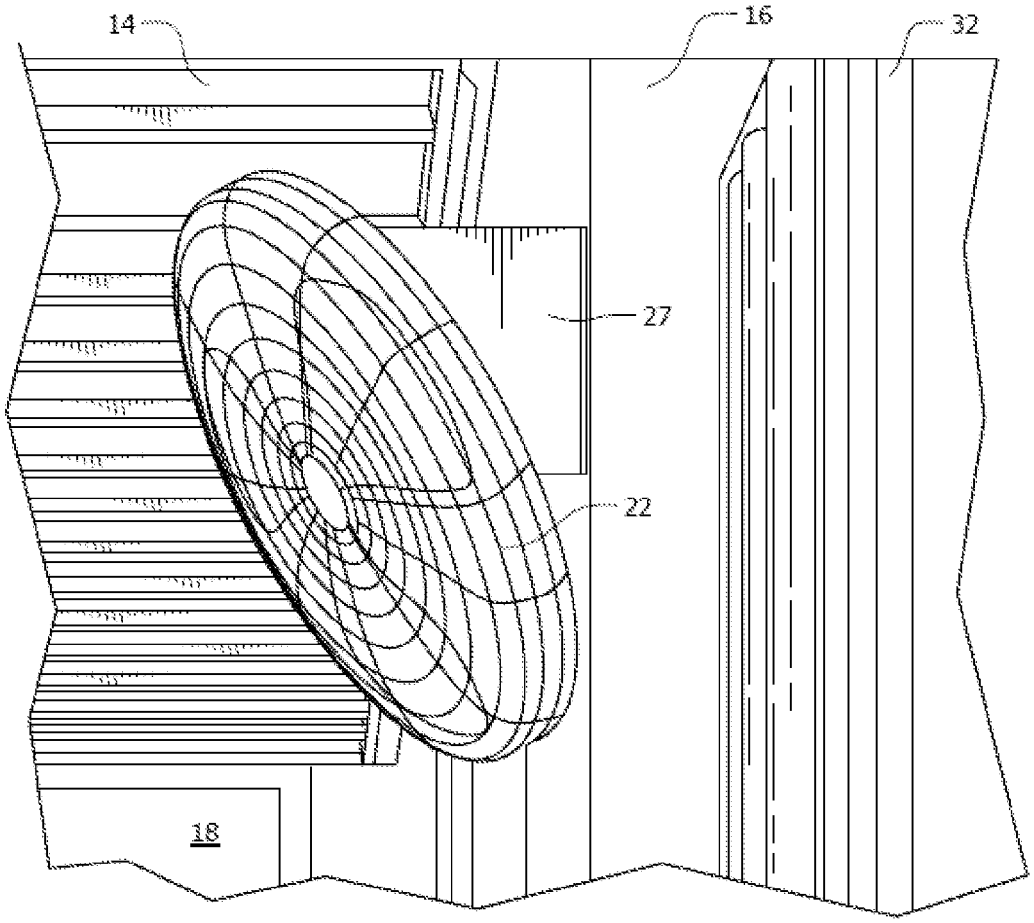
FIG. 4 is a schematic of a fan within a spray booth.

Filter media 30 may be placed on one or more vertical sides of plenum 20. This allows an appropriate speed of airflow to run through filter media 30 into fan 22 and onto object 34, thus minimizing the amount of dirt passing through filter media 30. FIG. 4 depicts filter media 30 placed on two opposing vertical sides of plenum 20, but other placements of filter media 30 are contemplated.

Referring to FIG. 1, an embodiment includes fan 22 disposed approximately at a 45 degree angle in an upper corner of spray booth 10 near the intersection of ceiling 14 and side wall(s) 16. It is contemplated that fan 22 can be attached to side wall(s) 16, as depicted in FIGS. 1, 3 and 4, and/or attached to ceiling 14, as depicted in FIG. 5.

Figure 3:
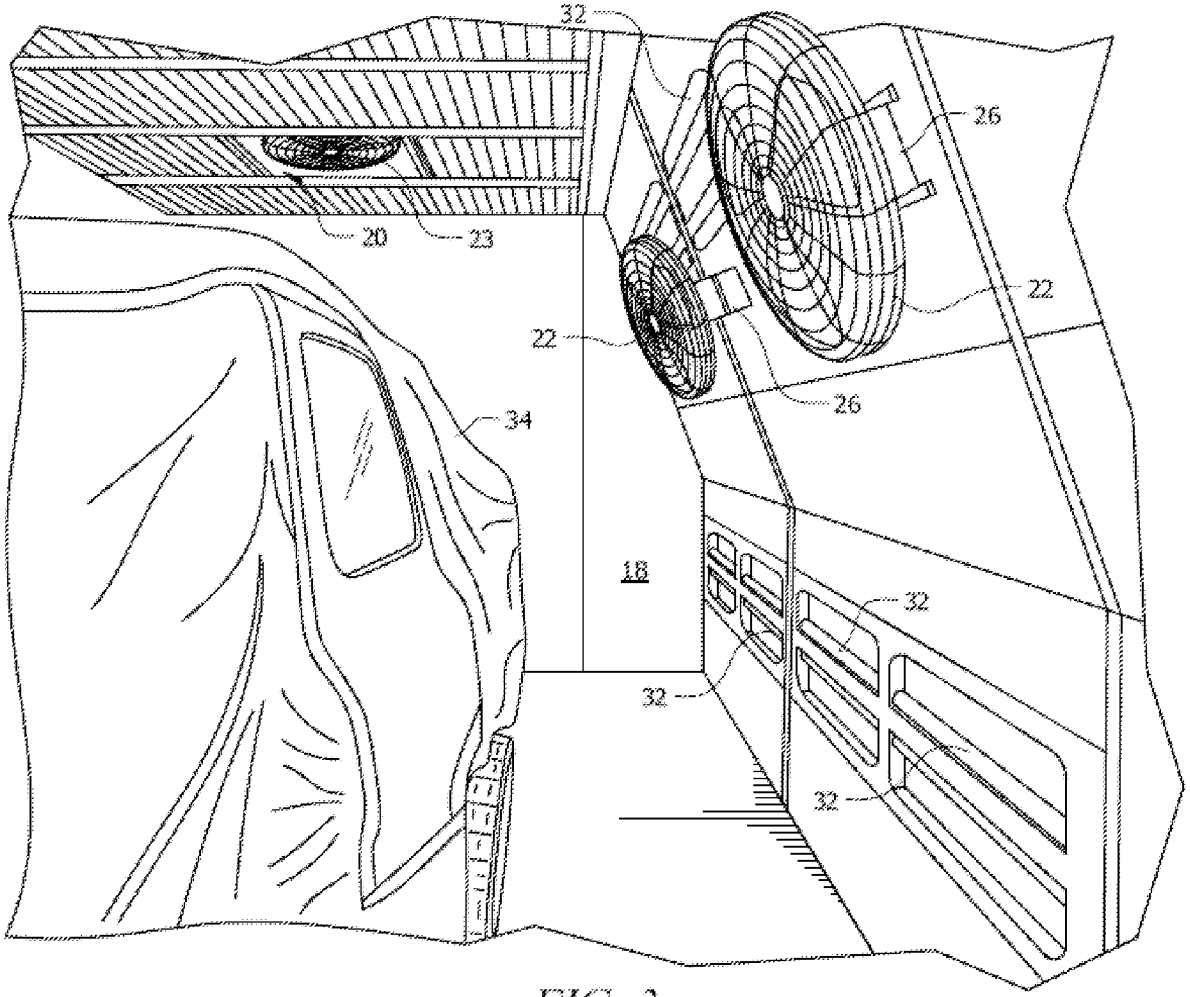
FIG. 3 is a schematic of a portion of a spray booth drying an object.
Figure 5:
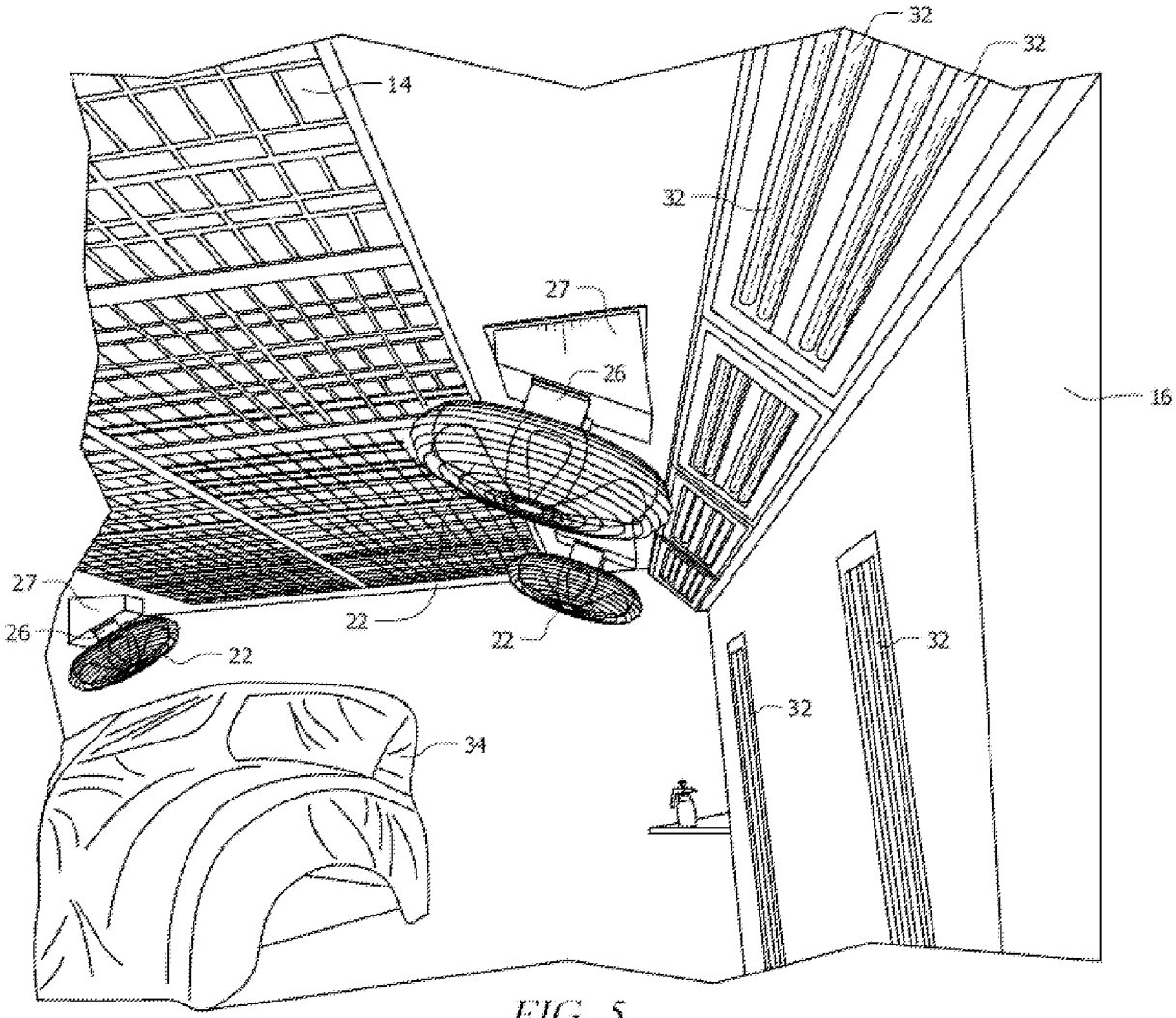
FIG. 5 is a schematic of a portion of a spray booth drying an object.

Side wall(s) 16 itself, or a portion thereof, may be disposed at an angle, as seen in FIGS. 1 and 3, or disposed substantially vertically, as seen in FIGS. 4 and 5. The position and 45 degree angle of the fan 22 increases the surface of object 34 exposed to the airflow.

For example, the airflow from fan 22 at a 45 degree angle in an upper corner of spray booth 10 near the intersection of ceiling 14 and side wall(s) 16 passes over both the top of object (e.g., a car) 34 and down the sides of object 34 at the same time. Mounting fan 22 at a 45 degree angle further allows for larger objects (e.g., a vehicle) to be placed in spray booth 10.

It is also contemplated that a fan in the upper corner of the spray booth may be disposed at an angle between about 20 degrees and about 70 degrees, relative to the ceiling 14 of spray booth 10. The angle may be lower than about 20 degrees, but the surface of the object exposed to the airflow may decrease. The angle may be greater than about 70 degrees, but the surface of the object exposed to the airflow may decrease.

In another embodiment, as depicted in FIGS. 1 and 3-5, variable sized spacers 26 can be used to mount fan 22 within interior 18 of spray booth 10. Non-use of spacers 26 can minimize the obstruction in spray booth 10 and allow for larger objects. However, this also provides only minimal area between fan 22 and interior 18 of spray booth 10 for sufficient air to pass. Thus, fan 22 is less effective for its intended purpose. When fan 22 is located off walls 16 and/or ceiling 14 via spacer 26, a greater amount of air is allowed to enter and exit fan 22 freely between interior 18 of spray booth 10 and fan 22, thus increasing airflow.

Spacer 26 may have a length of about two (2) inches to about eight (8) inches. Other lengths may be used, but shorter than about two (2) inches may not allow a sufficient amount of space for air to enter fan 22, and longer than about eight (8) inches may intrude on the size of object 34 in spray booth 10.

Spacer 26 may connect fan 22 to side wall 16 of spray booth 10 at a distance sufficient to allow air to enter and exit fan 22 and at an angle desired by the user. As depicted in FIGS. 4 and 5, spacer 26 may also include mounting frame 27 to which fan 22 can connect. Mounting frame 27 can be attached to interior wall 16 of spray booth 10 such that fan 22 can be pointed at an angle desired by the user, regardless of the angle of interior wall 16 and regardless of attachment to wall 16 or ceiling 14.

As depicted in FIGS. 1, 2 and 5, certain embodiments of the current invention may include heating lamps 32 that aid not only in the lighting of the surface of object 34 but also in the drying of the surface of object 34. Heating lamps 32 may be disposed on side walls 16 and/or ceiling 14 of housing 12.

In another embodiment, fans 22 may include a pulse setting, not shown. Breaking the surface tension is a requirement for drying water based paints, as water evaporates from the paint. The surface tension builds a bubble near the surface and increases paint drying time. Providing added airflow at a steady state flow potentially can form a small bubble. Pulsating speed may enable the airflow from the fans 22 to slow and speed up in predetermined time intervals. The time intervals can range from about one (1) second to about 120 seconds, or any other time interval. The pulse can break up the bubbles to minimum size or to nothing at all, allowing for quicker dry times.

In another embodiment, fans 22 include a gradually increasing airflow. Starting up fan 22 quickly can result in stirring up dirt off the non-painted surfaces. The dirt can then settle on the painted surfaces and ruin the paint. A start that gradually increases airflow to fan 22 has less of a rushing force and thus does not stir up the dirt. Fan 22 can start up slowly, taking anywhere from about one (1) second to about 120 seconds, or any other time interval, to reach the desired airflow speed.

In another embodiment, spray booth system 10 contemplates selectable fan control, not shown, which allows for user control over activation of fans 22, depending on what part of the object the user is painting. If airflow is being directed to an area of the object not being painted, dirt can be stirred up from the object, floors and walls. Thus, fan control, not shown, allows airflow to be directed at proper areas of the object.

In another embodiment, spray booth system 10 includes a delay timer, not shown. The delay timer, not shown, allows fan 22 or zone of fans to activate at predetermined time intervals, such that the dry time of the object within spray booth 10 can be optimized. In this way, the airflow can also be more evenly dispersed over the object. For example, if an individual paints one side of a vehicle, the delay timer, not shown, can program the zone of fans on that respective side of the spray booth to activate to blow air onto the painted side, while the individual begins painting the other side of the vehicle. In another example, the delay timer, not shown, can program the fans to activate at a predetermined time after the painter has completed painting the entire object, thus normalizing airflow distribution and minimizing dry time.

Figure 6:
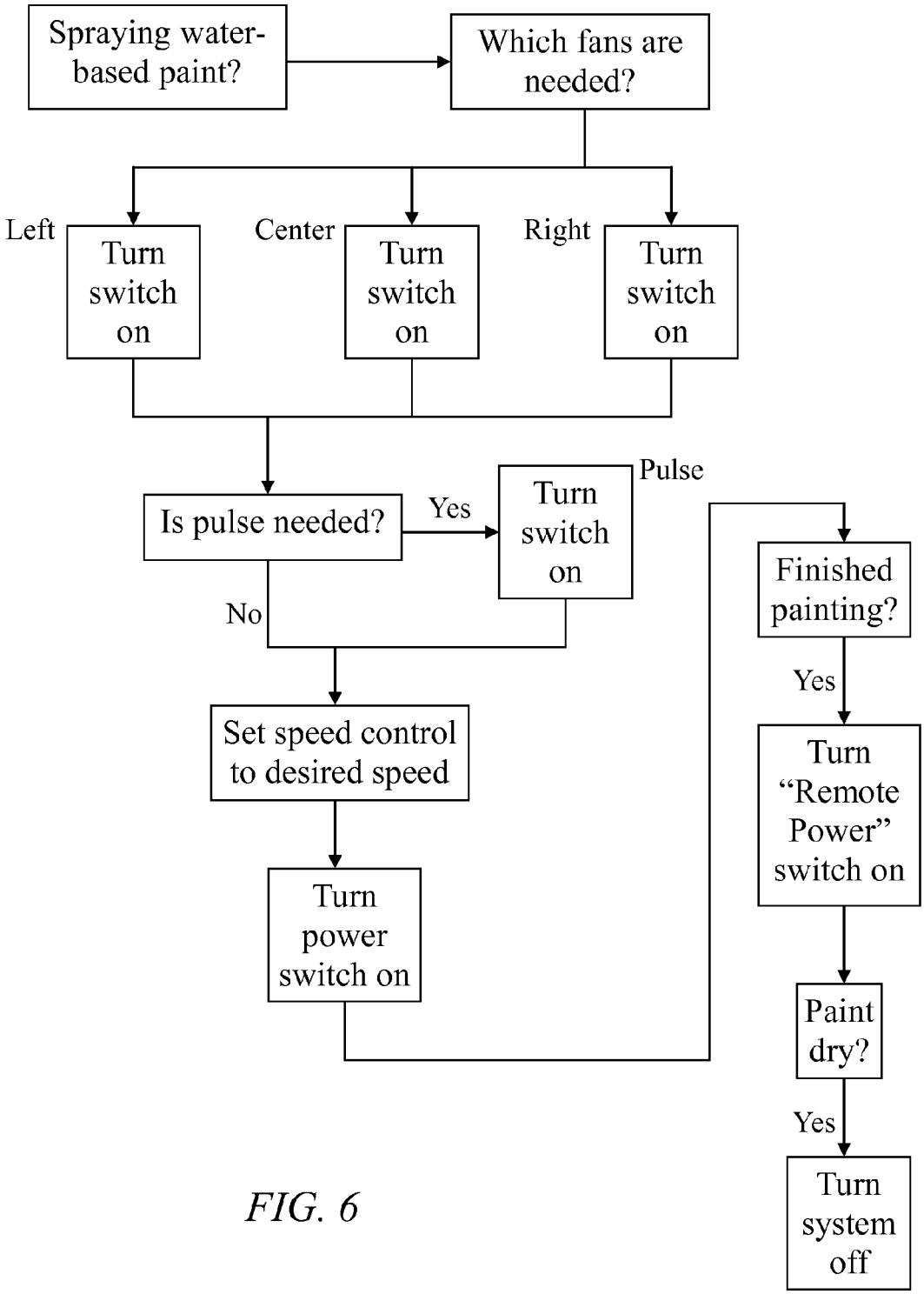
FIG. 6 is a flow chart for controlling the airflow within a spray booth, assuming all switches are turned in the "off" position at commencement.

In another embodiment, a conventional control panel is used to control the spray booth system using a method depicted in FIG. 6. A user first determines what type of paint is being used in the spray booth. Next, the user determines which fan zone will be used. Each fan is associated with a zone within the housing. Each zone may include one fan or a plurality of fans. It is then determined whether a pulsating airflow will be used. The speed of the fan zone is also selected. The power to the system is then turned on and painting is initiated. It is then determined whether the paint is dry and whether to adjust the setting accordingly.

As a whole, the control panel may comprise of variable frequency drives, motor starters with overloads for each zone of fans, circuit breakers for electrical protection, timers for pulse, potentiometers and switches, among other appropriate features to optimize function of the spray booth system.

GLOSSARY OF CLAIM TERMS

The term "airflow" is used herein to refer to the motion of air or gas in a confined area, said air or gas being emitted from a device. For example, a fan may emit air having an airflow that dries an object within a spray booth.

The term "ceiling" is used herein to refer to a surface that bounds the upper limit of a confined area. A ceiling may have a flat, substantially horizontal surface, a curved or angular surface, etc.

The term "ceiling fan" is used herein to refer to a fan fixture attached to or built within a ceiling overlying a confined area. Generally, a ceiling fan is disposed near the center of their proportional boundaries. For example, if only one ceiling fan is present, it can be in the horizontal center of the ceiling. If two ceiling fans are present, a first fan can be disposed at one-third length of the ceiling, and a second fan can be disposed at two-thirds length of the ceiling.

The term "control panel" is used herein to refer to a device onto which controls, instruments and/or displays are mounted. A control panel must be able to suitably regulate apparatuses to which the control panel is mechanically or wirelessly connected.

As used herein, the terms "cured" and "sprayed" are used interchangeably to refer to preserving an object in a confined area, heating an object, and/or evaporating moisture (water, paint, etc.) from an object.

The term "delay timer" is used herein to refer to a device the delays or separates the occurrence of two events, especially in a mechanical or electronic device. For example, as used herein, a delay timer could be used to delay spraying or curing an object (i.e., second event) after the object has been placed in a spray booth (i.e., first event).

The term "fans" is used herein to refer to an electrical or mechanical device for moving air or creating airflow. For example, fans can be used to cool, heat, vent or dry an object using the airflow created.

The term "filter media" is used herein to refer to a device that separates unwanted particulate and/or gas from a confined area. For example, air can be sent through a filter medium and be separated from any particulate that a user does not want distributed through the filter medium.

The term "housing" is used herein to refer to a container that may enclose and protect an object. A housing can be created by adjoining a base or flooring, side walls and a ceiling to prevent external substances (e.g., liquid, air, etc.) from entering.

The term "interior" is used herein to refer to the inside of an enclosed structure. An interior is capable of containing an object. For example, an interior of a spray booth can contain a vehicle to be sprayed or cured. An interior is defined by the housing or the walls and ceiling of the enclosed structure.

The term "interior wall" is used herein to refer to a structure that adjoins a base or flooring with a ceiling of a building. Interior walls are used both as the exterior of the building and also to define the interior of the building. Interior walls may be substantially vertical or beveled according to a user's specifications. Structures, such as fans, can be attached to the interior walls using any conventional fastener.

The term "lateral dryer" is used herein to refer to fans that create airflows primarily on the sides or upper sides of an object within a building and secondarily over the top of the object. Fans can be held stationary at a distance away from an interior wall of ceiling by use of spacers and/or mounting frames. Thus, a lateral dryer disposed on an interior wall of a spray booth would emit airflows that primarily contact an object's sides or upper sides (e.g., sides of a vehicle's roof) and secondarily contact the object's top/roof.

The term "length" is used herein to refer to a measurement of distance along the longest dimension of a structure. Thus, the length of a rectangular prism is a measurement of its longest side or side protruding from a support (e.g., side wall of a spray booth).

The term "mechanical" is used herein to refer to the nature of a physical, tangible connection between two structures. For example, if a control panel is connected mechanically to fans within a spray booth, it may be connected via one or more wires to the spray booth or fans.

The term "mounting frame" is used herein to refer to a support structure from which either a spacer may protrude or a fan may be connected. A mounting frame aids in holding a fan in place at a certain distance from an interior wall of a spray booth.

The term "object" is used herein to refer to any structure that can be sprayed, cured, protected, or dried by use of airflows emitted from fans. An example includes a vehicle or automobile. However, other objects are contemplated.

The term "overhead dryer" is used herein to refer a fan that creates airflows primarily over the top of an object within a building and secondarily on the sides or upper sides of the object. Thus, a fan disposed on or within a ceiling of a spray booth would emit airflows that primarily contact an object's top/roof and secondarily contact the object's sides or upper sides. An overhead dryer can further include a plenum and filter media to purify air or gas entering the fan and emitted by the fan as airflow contacting the object underneath.

The term "plenum" is used herein to refer to a space disposed within a ceiling of a building. The recess of a plenum may contain structures, such as a ceiling fan and/or filter media, that can be used to create proper airflow for spraying or curing an object underneath.

The term "predetermined angle" is used herein to refer to an angle at which a user determines is appropriate for a fan to be disposed for properly spraying or curing an object. Spacers and/or mounting frames allow a fan to be disposed at the predetermined angle. The angle is measured either from the side wall or ceiling from which the fan protrudes.

The term "predetermined speed" is used herein to refer to a rate at which blades of a fan are operated, as determined by a user. Speed and amount of airflow have a direct relationship. Thus, a higher predetermined speed creates a larger amount of airflow contacting an object being sprayed or cured. A user may determine the optimal amount of airflow needed for an object by selecting a speed at which the fans will operate.

The term "pulsating frequency" is used herein to refer to the rate of occurrence of a recurring increase and decrease of some quantity. For example, as used herein, a fan that operates at a pulsating frequency repeatedly increases airflow and decreases airflow over a period of time.

The term "recess" is used herein to refer to a space within a larger structure. For example, a recess within a plenum refers to the space within the plenum. Other structures may be disposed within the recess.

The term "selectable fan zone control" is used herein to refer to the ability to select which fans are engaged at a particular time. For example, if an automobile's fender has been painted and needs to be sprayed, selectable fan zone control allows a user to engage only the fan that creates airflows around the fender rather than spraying the automobile in unneeded areas, as this might even be detrimental to the spraying process.

The term "spacers" is used herein to refer to a structure that supports a structure at a predetermined distance away from a wall. A spacer may hold a fan at a distance away from the wall to allow a sufficient amount of air to enter and be emitted from the fan. It is contemplated that the length of spacers may be adjustable.

The term "stationary" is used herein to refer to the inability of a structure to move or change. Thus, a fan held in a stationary position would not be able to be moved or changed while in operation. However, it is contemplated that the head of the fan could oscillate according to conventional methods.

The term "sufficient air" is used herein to refer to an amount of air or gas needed to enter a fan and be pushed through the fan to create airflow necessary to spray or cure an objection, or part thereof.

The term "upper corner" is used herein to refer to the intersection of an interior wall and a ceiling of a building along the length or width of the building. If a fan is disposed near an upper corner of a spray booth, the fan can create airflow that would contact the sides and upper sides of the object being sprayed or cured.

The term "vertical side" is used herein to refer to a planar surface of a structure, said planar surface running in a substantially vertical direction. Thus, filter media disposed on a vertical side of a plenum would be disposed on a substantially vertical planar surface of the plenum.

The term "wireless" is used herein to refer to a connection between two structures without the use of wires. For example, the two structures may have access points connected via a wireless network or Bluetooth. Any known conventional methods of wirelessly connecting two structures (e.g., a control panel and a fan) may be used.

The term "vehicle" is used herein to refer to a device for carrying or transporting substances, objects or individuals. Examples include automobiles, boats, pallets, etc.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A spray booth, comprising:

a housing having a ceiling and a set of interior walls that define an interior for confining an object to be sprayed or cured;

a plurality of spacers, each spacer having a first end and a second end within said interior of said spray booth, wherein said first end of said each spacer is attached to said ceiling or an interior wall selected from said set of interior walls; and a plurality of fans within said interior of said spray booth, wherein each fan is attached to said second end of said each spacer at a predetermined angle between about twenty (20) degrees and about seventy (70) degrees, wherein said each spacer has a length that allows sufficient air to pass between said each fan and said ceiling or said interior wall to increase airflow.

2. The spray booth of claim 1, wherein said each spacer further comprises a mounting frame.

3. The spray booth of claim 1, wherein said predetermined angle is about 45 degrees.

4. The spray booth of claim 1, wherein said length of said each spacer is between about two (2) inches and about eight (8) inches.

5. The spray booth of claim 1, said each spacer and said each fan are disposed in an upper corner of said spray booth near an intersection of said ceiling and said interior wall of said spray booth.

6. The spray booth of claim 1, further comprising:

a plenum having a recess therein and including a filter media on at least one vertical side of said plenum; and a ceiling fan disposed within a recess of said ceiling of said spray booth;

said plenum being disposed in overlying relation to said ceiling fan.

7. The spray booth of claim 1, further comprising a selectable fan zone control.

8. The spray booth of claim 1, wherein said each fan gradually increases said airflow onto said object.

9. The spray booth of claim 1, wherein said each fan engages at a pulsating frequency, whereby airflow pulses onto said object.

10. The spray booth of claim 1, further comprising a delay timer connected mechanically or wirelessly to said each fan.

11. The spray booth of claim 1, further comprising a control panel to control airflow onto said object throughout said spraying or curing or said object, said control panel connected mechanically or wirelessly to said each fan.

12. An assembly for a spray booth, the assembly comprising:

a first component, comprising a housing having a ceiling and a set of interior walls that define an interior for confining an object to be sprayed or cured;

a second component comprising a lateral dryer, said lateral dryer including:

a plurality of fans within said interior of said spray booth, each fan disposed at a predetermined angle between about twenty (20) degrees and about seventy (70) degrees relative to said ceiling, and a plurality of spacers, each spacer having a first end and a second end, said first end including a mounting frame and attached to the ceiling or at least one interior wall selected from said set of interior walls near an intersection of said ceiling and at least one interior wall selected from said set of interior walls, wherein said each spacer has a length between about two (2) inches and about eight (8) inches;

a third component comprising an overhead dryer, said overhead dryer including:

a ceiling fan disposed within a recess of said ceiling, and a plenum containing filter media on at least one vertical side of said plenum, wherein said plenum is disposed in overlying relation to said ceiling fan.

13. An assembly as in claim 12, further comprising a fourth component, said fourth component comprising a delay timer connected mechanically or wirelessly to the at least one fan.

14. An assembly as in claim 12, further comprising a fourth component, said fourth component comprising a control panel connected mechanically or wirelessly to the at least one fan.

15. A method of spray drying a vehicle, said method comprising the steps of:

providing a spray booth containing said vehicle, said spray booth including a ceiling and set of interior walls;

disposing a plurality of fans on said set of interior walls;

disposing a ceiling fan within a recess of said ceiling, said ceiling fan remaining stationary in overlying relation to said vehicle;

determining one or more fans selected from said plurality of fans and said ceiling fan that are needed for said spray drying;

engaging said one or more fans at a predetermined speed to create airflows within said spray booth in response to said determination;

determining whether said one or more fans need to be operating at a pulsating frequency;

engaging said one or more fans at said pulsating frequency in response to said determination; and allowing said vehicle to receive airflows from said plurality of fans and said ceiling fan, whereby said vehicle is dried.

* * * * *